US006124853A

United States Patent [19]

Palalau et al.

[11] Patent Number: 6,124,853

[45] Date of Patent: Sep. 26, 2000

[54] POWER DISSIPATION CONTROL FOR A VISUAL DISPLAY SCREEN

[75] Inventors: Silviu Palalau, Birmingham, Mich.; William Rogers, Suffield, Conn.

[73] Assignee: Lear Automotive Dearborn, Inc., Southfield, Mich.

[21] Appl. No.: 08/707,329

[22] Filed: Sep. 3, 1996

[51] Int. Cl.[7] ..... G09G 5/00; G09G 3/36

[52] U.S. Cl. ..... 345/212; 345/99; 345/100; 713/324

[58] Field of Search ..... 345/103, 100, 345/94, 208, 211, 212, 209, 213, 97, 98, 99, 93, 90; 713/320, 323, 324

[56] References Cited

U.S. PATENT DOCUMENTS

| | | | |
|---|---|---|---|
| 4,679,043 | 7/1987 | Morokawa | 345/103 |
| 4,982,183 | 1/1991 | Flegal et al. | 345/212 |
| 5,017,914 | 5/1991 | Uchida et al. | 345/90 |
| 5,394,166 | 2/1995 | Shimada | 345/98 |
| 5,426,447 | 6/1995 | Lee | 345/103 |
| 5,465,366 | 11/1995 | Heineman | 713/324 |
| 5,508,716 | 4/1996 | Prince et al. | 345/103 |
| 5,510,807 | 4/1996 | Lee et al. | 345/103 |
| 5,576,738 | 11/1996 | Anwyl et al. | 345/212 |
| 5,598,565 | 1/1997 | Reinhardt | 345/212 |
| 5,610,627 | 3/1997 | Inamori et al. | 345/99 |
| 5,703,616 | 12/1997 | Kawasugi | 345/98 |
| 5,757,365 | 5/1998 | Ho | 345/212 |
| 5,805,121 | 9/1998 | Burgan et al. | 345/103 |
| 5,852,426 | 12/1998 | Erhart et al. | 345/211 |
| 5,881,299 | 3/1999 | Nomura et al. | 345/212 |
| 5,926,173 | 7/1999 | Moon | 345/211 |
| 5,991,827 | 11/1999 | Ellenby et al. | 345/212 |

FOREIGN PATENT DOCUMENTS

0238867A3 2/1987 European Pat. Off. .

*Primary Examiner*—Steven J. Saras
*Assistant Examiner*—Paul A. Bell
*Attorney, Agent, or Firm*—Niro, Scavone, Haller & Niro

[57] ABSTRACT

A visual display screen is partitioned into a plurality of screen portions. Power drivers associated with the screen portions are grouped selectively according to the number of screen portions. The power supplied to each group of drivers is selectively controlled to select which screen portions receive power at any given time. In the event that a screen portion is not active for a current display after a preselected minimum amount of time, that screen portion is disabled because the power to that screen portion is selectively turned off.

13 Claims, 1 Drawing Sheet

POWER DISSIPATION CONTROL FOR A VISUAL DISPLAY SCREEN

BACKGROUND OF THE INVENTION

This invention generally relates to electronic visual display screens. More particularly, this invention relates to a system and method for controlling power dissipation in a visual display screen.

A variety of electronic visual display screens are currently used in a variety of applications. Workers in the art are constantly trying to improve the operating parameters of electronic visual display screens. For example, a "screen-saver" program is typically provided with a home computer for reducing the possibility of damage to the computer monitor display as a result of leaving a static image on the screen for a prolonged period of time.

Conventional screen-savers may not be useful, however, in all applications. For example, when a visual screen display is incorporated into a vehicle, it may be necessary to keep at least part of the screen active at all times. Therefore, conventional screen-savers, which typically disrupt the display on the entire screen, are not useful in such situations. Further, some applications require a minimization of power usage. Conventional screen savers do not adequately address such situations. Accordingly, there is a need for an improved system and method for controlling a display on an electronic visual display screen.

This invention is a system and method that is useful for controlling selected portions of a visual display screen. The system and method of this invention provide the ability to selectively disable or turn off portions of a visual display screen to reduce the amount of power dissipated by the screen and to protect the screen from potential damage.

SUMMARY OF THE INVENTION

In general terms, this invention is a system for controlling an electrically generated display. The system includes a display screen having a matrix of a plurality of screen portions wherein the matrix includes a plurality of columns and a plurality of rows. A plurality of power drivers are associated with the plurality of columns. Similarly, a plurality of power drivers are associated with the plurality of rows. An electronic controller controls the display on the display screen. A plurality of power switches couple the power drivers to the electronic controller. A power control module that is coupled to the power switches and the power drivers selectively controls a supply of power to the power drivers depending on an operation condition of the power switches.

In general terms, the method of this invention is a method of controlling power usage for a visual display screen. The method includes several basic steps. First, the visual display screen is divided into a plurality of display surfaces. Power is supplied to all of the display surfaces. A display is generated on the display screen. Next, an inactive display surface is defined as a display surface that has not included at least a portion of the generated display for at least a preselected period of time. A determination is made whether any of the display surfaces is an inactive display surface. The power to any inactive display surface is then shut off once such a determination is made.

The various features and advantages of this invention will become apparent to those skilled in the art from the following detailed description of the presently preferred embodiment. The drawings that accompany the detailed description can be described as follows.

DETAILED DESCRIPTION OF THE PREFERRED EMBODIMENT

Figure 1:
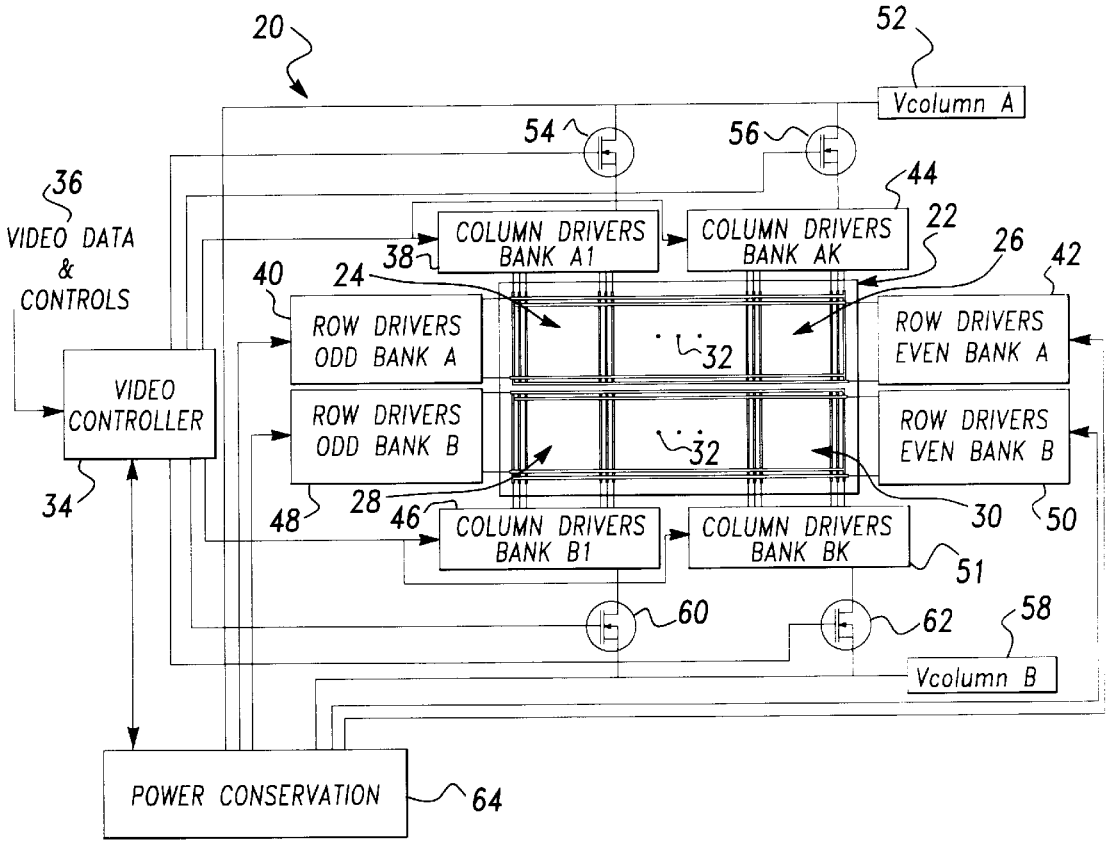
FIG. 1 is a schematic illustration of a system designed according to this invention.

FIG. 1 schematically illustrates a system 20 for controlling the power dissipation and display on a visual display screen 22. The display screen 22 is divided into a plurality of screen portions including the illustrated portions 24, 26, 28 and 30. The ellipses 32 indicate that any number of screen portions can exist between the illustrated portions. The screen portions preferably are immediately adjacent each other so that the entire display screen 22 is accounted for by a screen portion.

A video controller 34, which is a conventional microprocessor or computer unit, controls the display on the display screen 22. Data 36 from various subsystems coupled with the controller 34 and video data from computer memory, for example, are supplied to the video controller 34 for generating the display on the display screen 22.

The display screen 22 is divided into a number of pixels as is understood by those skilled in the art. The screen pixels are arranged in a matrix having locations identifiable by column and row position. Each screen pixel preferably is powered by a column voltage and a row voltage. Accordingly, each screen portion is made up of a plurality of screen pixels.

According to this invention, electrodes for providing a column voltage are divided and the outputs are grouped into banks of column drivers. One column driver bank is associated with each screen portion. For example, a column driver bank 38 is associated with the screen portion 24. The screen pixels within the screen portion 24 are powered by the column drivers 38 and the row drivers 40 and the row drivers 42. The bank of row drivers 40 accounts for the odd numbered rows through the screen portion 24, while the row drivers 42 account for the even numbered rows through the screen portion 24. Similarly, the column voltages for the screen pixels in the screen portion 26 are provided through the bank of column drivers 44. The row voltages of the pixels in the screen portion 26 are provided through the bank of row drivers 40 and 42. The screen portion 28 is powered through the column driver bank 46 and the row driver banks 48 and 50. Likewise, the screen portion 30 is powered through the column drivers bank 51 and the row driver banks 48 and 50.

In the illustrated embodiment, the screen 22 is effectively divided into a top half and a bottom half. The top half and the bottom half each have a designated number of row drivers associated with them. The top half is then effectively subdivided into a plurality of screen portions and the bottom half is similarly subdivided into a plurality of screen portions. It is also possible, according to this invention, to subdivide the screen from top to bottom into more screen portions where necessary.

A voltage source 52 provides the power to the column drivers 38 through a power switch 54. The power switch 54 preferably is an FET type switch. The voltage source 52 also powers the column driver bank 44 through a power switch 56. Another voltage source 58 is used for powering the column drivers 46 through a power switch 60 and the column driver bank 51 through a switch 62. All of the switches 54, 56, 60 and 62 preferably are FET switches.

A power conservation module 64 is coupled to the power switches 54, 56, 60 and 62. The power conservation module is also coupled to the voltage sources 52 and 58 and the row driver banks 40, 42, 48 and 50. Any conventional microprocessor or computer can be used as the power conservation module 64.

The power conservation module 64 selectively disconnects any of the column dryer banks from their respective voltage sources by controlling the power switches. Although it is not specifically illustrated in FIG. 1, the row driver banks preferably are powered in a manner similar to that illustrated for powering the column driver banks. Accordingly, the power conservation module 64 can also turn off the power to the row driver banks.

The power module 64 controls the power to the various row and bank drivers. The power supplied to different driver banks is selectively controlled by the power module 64 to reduce the amount of power dissipation in the display screen 22. Reducing the amount of power dissipation when a display screen is used in a vehicle is especially advantageous because the overall amount of electrical power available on a vehicle is limited for practical reasons. In the preferred embodiment, a timer and monitoring module within the controller 34 monitors the power switches and determines whether the switches are active. When a control switch has not been active for a preselected period of time, the video controller 34 modifies the horizontal and vertical synchronization signals that are supplied to the screen 22. The controller 34 communicates with the power module 64 that responsively disconnects one or more of the banks of drivers from its respective voltage source.

In an alternative embodiment, the internal timer and the monitoring module are located within the power module 64. In that embodiment, the communications between the controller 34 and the power module 64 are modified appropriately.

The preselected minimum amount of time for a power switch to be inactive, which indicates that a corresponding screen portion is inactive, depends upon a particular application. Given this specification, one skilled in the art can develop specific software for achieving the monitoring, timing and power switching functions associated with this invention.

Figure 2:
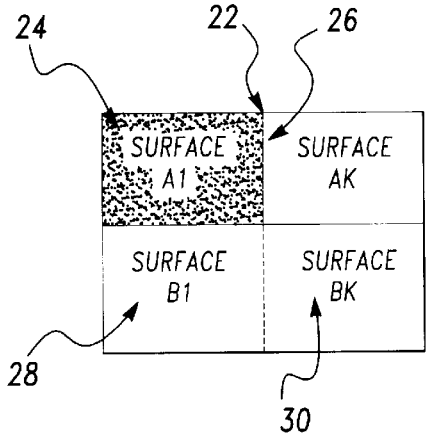
FIG. 2 is a schematic illustration of a visual display screen associated with this invention.

FIG. 2 schematically illustrates the display screen 22 divided into four screen portions. Assuming that the power switches for the screen portions 26, 28 and 30 have been inactive for more than a preselected minimum amount of time, the controller 34 communicates with the power module 64 that those screen portions can be disabled because they are not being used for the current display. The power module responsively disables the screen portions 26, 28 and 30 by turning off the appropriate power switches to disconnect the appropriate drivers from their respective voltage source. Accordingly, only the screen portion 24 receives power and generates the current display.

In the event that the controller 34 determines that a new display or additional display is required on the screen 22, it communicates with the power module 64. The power module 64 then responsively provides power to the necessary screen portions of the screen 22.

The strategy for dividing the screen 22 into a plurality of screen portions according to this invention can be summarized as follows. The screen 22 preferably is partitioned into 2K screen portions, where K is an integer greater than or equal to 2. The column electrodes are then split and the column outputs are grouped into K banks of column drivers. In FIG. 2, for example, K equals 2. Under the scenario described above, the screen portion 24 is the only active surface of the display. Since there are two column banks, the column bank associated with the screen portions 26 and 30 is disabled. The row drivers associated with the screen portions 28 and 30 are also disabled. Accordingly, the amount of power utilized by the screen 22 is reduced by approximately 75% and only one-quarter of the screen is powered as needed.

The foregoing description is exemplary rather than limiting in nature. Modifications and variations to the disclosed embodiment will become apparent to those skilled in the art that do not necessarily depart from the purview and spirit of this invention. Accordingly, the legal scope afforded to this invention can only be determined by studying the appended claims.

What is claimed is:

1. A system for controlling an electrically generated display, comprising:

a display screen having a matrix of a plurality of screen portions wherein said matrix includes a plurality of columns and a plurality of rows;

a plurality of column power drivers associated with said plurality of columns for providing column voltages for the screen pixels in the screen portions;

a plurality of row power drivers associated with said plurality of rows for providing row voltages for the screen pixels in the screen portions;

an electronic controller for controlling a display on said display screen; and a power control module in communication with said controller and a timer for determining when at least one of said screen portions is inactive and does not contain any part of a current display and disabling said power drivers associated with said inactive portion.

2. The system of claim 1, wherein said plurality of column power drivers are grouped into a plurality of column banks, each said column bank including a plurality of column power drivers, each said column bank being associated with at least one said screen portion, and wherein said plurality of row power drivers are grouped into a plurality of row banks, each said row bank including a plurality of row power drivers and each said row bank being associated with at least one said screen portion.

3. The system of claim 2, further comprising a power source dedicated to powering said power drivers, and a plurality of power switches coupled with said electronic controller such that said electronic controller controls an operation condition of said switches as said electronic controller controls said display, wherein one of said power switches is associated with each bank, respectively, and wherein said power control module selectively disconnects a selected one of said banks from said power source responsive to the operation condition of an associated power switch.

4. The system of claim 3, wherein said electronic controller includes a monitor module that determines said operation condition of said power switches, said operation condition including an active state and an inactive state and wherein said electronic controller includes a timer module that determines an amount of time that any one of said power switches has an operation condition that corresponds to an inactive state.

5. The system of claim 4, wherein said electronic controller is coupled to said power control module and communicates to said power control module to selectively disconnect one of said banks from said power source when said associated power switch has an operation condition that corresponds to an inactive state for a preselected minimum amount of time.

6. The system of claim 2, wherein said display screen has K screen portions, where K is an integer that is greater than or equal to 2, and wherein there are K column banks.

7. The system of claim 1, further comprising a plurality of power switches having operation conditions indicative of an activation state of said power drivers associated with each said switch, respectively, and wherein said electronic controller includes a monitor module that determines said operation condition of said power switches, said operation condition including an active state and an inactive state and wherein said electronic controller includes a timer module that determines an amount of time that any one of said power switches has an operation condition that corresponds to an inactive state.

8. The system of claim 7, wherein said electronic controller is coupled to said power control module and communicates to said power control module to selectively disable selected ones of said power drivers when an associated power switch has an operation condition that corresponds to an inactive state for a preselected minimum amount of time.

9. The system of claim 1, further comprising a plurality of power switches having operation conditions indicative of an activation state of said power drivers associated with each said switch, respectively, and wherein said power control module includes a monitor that determines said operation condition of said power switches, said operation condition including an active state and an inactive state and wherein said power control module includes a timer that determines an amount of time that any one of said power switches has an operation condition that corresponds to an inactive state, and wherein said power control module selectively disables selected ones of said power drivers when an associated power switch has an operation condition that corresponds to an inactive state for a preselected minimum amount of time.

10. A method of controlling power usage for a visual display screen, comprising the steps of:

(A) dividing the display screen into a plurality of display surfaces;

(B) generating a display on the display screen;

(C) monitoring the display screen by using a timer to determine if any of said display surfaces is an inactive display surface that has not contained at least a portion of the generated display for at least a preselected period of time;

(D) disabling any inactive display surfaces determined to be an inactive display surface from step (C).

11. The method of claim 10, wherein there is an electronic component associated with each of the display surfaces and wherein step (C) is performed by defining an inactive state as one where an associated electronic component has not been active for the preselected period of time and determining whether any of the associated electronic components has an inactive state.

12. The method of claim 10, wherein step (D) is performed by turning off all power to any inactive display surface.

13. The method of claim 10, wherein there are pluralities of power drivers associated with each display surface, respectively, wherein step (B) is performed by powering selected ones of the pluralities of power drivers, and wherein step (D) is performed by turning off all power to the pluralities of power drivers associated with any inactive display surface.

* * * * *